US012796821B2

(12) United States Patent
Brenton

(10) Patent No.: US 12,796,821 B2
(45) Date of Patent: Nov. 17, 2026

(54) CUSHION DEVICE

(71) Applicant: Charles Brenton, Terre Haute, IN (US)

(72) Inventor: Charles Brenton, Terre Haute, IN (US)

( * ) Notice: Subject to any disclaimer, the term of this patent is extended or adjusted under 35 U.S.C. 154(b) by 0 days.

(21) Appl. No.: 19/047,059

(22) Filed: Feb. 6, 2025

(65) Prior Publication Data

US 2026/0224033 A1 Aug. 6, 2026

(51) Int. Cl.
*A47C 7/02* (2006.01)
*A47C 7/18* (2006.01)
*A47G 9/10* (2006.01)

(52) U.S. Cl.
CPC ..... *A47C 7/021* (2013.01); *A47C 7/029* (2018.08); *A47C 7/18* (2013.01); *A47G 2009/1018* (2013.01)

(58) Field of Classification Search
CPC ..... A47C 7/021; A47C 7/029; A47C 7/18; A47G 9/10; A47G 9/1027; A47G 2009/1018
USPC ..... 5/648, 653; 297/452.22, 452.21, 452.41
See application file for complete search history.

(56) References Cited

U.S. PATENT DOCUMENTS

2012/0255127 A1* 10/2012 Goodwin ..... A61G 7/05723 5/652
2015/0208812 A1* 7/2015 Fenton ..... A47C 20/02 5/632
2017/0000263 A1* 1/2017 Krishtul ..... A47C 7/029
2017/0164754 A1* 6/2017 Alletto, Jr. ..... A47C 20/027

FOREIGN PATENT DOCUMENTS

CN 211883583 U * 11/2020

* cited by examiner

*Primary Examiner* — Justin C Mikowski
*Assistant Examiner* — Deborah Talitha Gedeon

(57) ABSTRACT

A cushion for suspending a tailbone of a user over a chair includes a ring cushion that is removably positionable on the chair. The ring cushion has an outer edge surrounding an inner edge which defines a cavity extending through the ring cushion. The cavity is positionable around the tailbone of the user and the inner edge surrounds a pair of gluteus medium muscles of the user. A base is fixedly attached to the ring cushion whereby the base and the ring cushion suspend the tailbone and the pair of gluteus medium muscles of the user above the chair. The base is rigid to inhibit the ring cushion from being compressed into the seat while the user is seated on the ring cushion. A pair of depressions extending into the ring cushion are positionable beneath a pair of legs of the user.

11 Claims, 8 Drawing Sheets

CUSHION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cushions and more particularly pertains to a new cushion for suspending a tailbone of a user over a chair.

(2) Description of Related Art Including Information Disclosed Under 37 CFR 1.97 and 1.98

The prior art relates to cushions. Cushions are commonly used to increase comfort for a user, whether the user is sitting, standing, or laying down on the cushion. For example, many chairs have cushions on the seat. Some prior art references also disclose portable seat cushions, which are popular when attending athletic events and when users are going to sit on hard, uncomfortable benches and chairs. These cushions typically include a planar rectangular pad which the user can place over the bench or chair. However, such cushions are typically ineffective when the user has an injury to their tailbone or lower back. Compression on the tailbone when such users are seated on the cushion may continue to cause discomfort, regardless of the softness of the material used to make the cushion. Thus, there is a need in the art for a cushion that can suspend a tailbone of a user above the chair, allowing the user to sit comfortably without compressing the tailbone and lower back.

BRIEF SUMMARY OF THE INVENTION

An embodiment of the disclosure meets the needs presented above by generally comprising a chair having a seat wherein the chair is configured to support a user. A ring cushion is removably positionable on the seat wherein the ring cushion is configured to be positionable between the seat and the user. The ring cushion has an outer edge surrounding an inner edge. The inner edge defines a cavity that extends through the ring cushion. The cavity has a diameter exceeding a distance being measured between the outer edge and the inner edge wherein the cavity is configured for being positioned around a tailbone of the user while the user is seated on the ring cushion and wherein the inner edge is configured to surround a pair of gluteus medium muscles of the user.

A base is fixedly attached to the ring cushion wherein the base is configured to support the ring cushion on top of the seat of the chair whereby the base and the ring cushion are configured to suspend the tailbone and the pair of gluteus medium muscles of the user above the seat of the chair. The base is rigid wherein the base is configured to inhibit the ring cushion from being compressed into the seat while the user is seated on the ring cushion. A pair of depressions extend into a top side of the ring cushion. The pair of depressions are spaced from each other wherein the pair of depressions are configured to be positionable beneath a pair of legs of the user when the user is seated on the ring cushion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
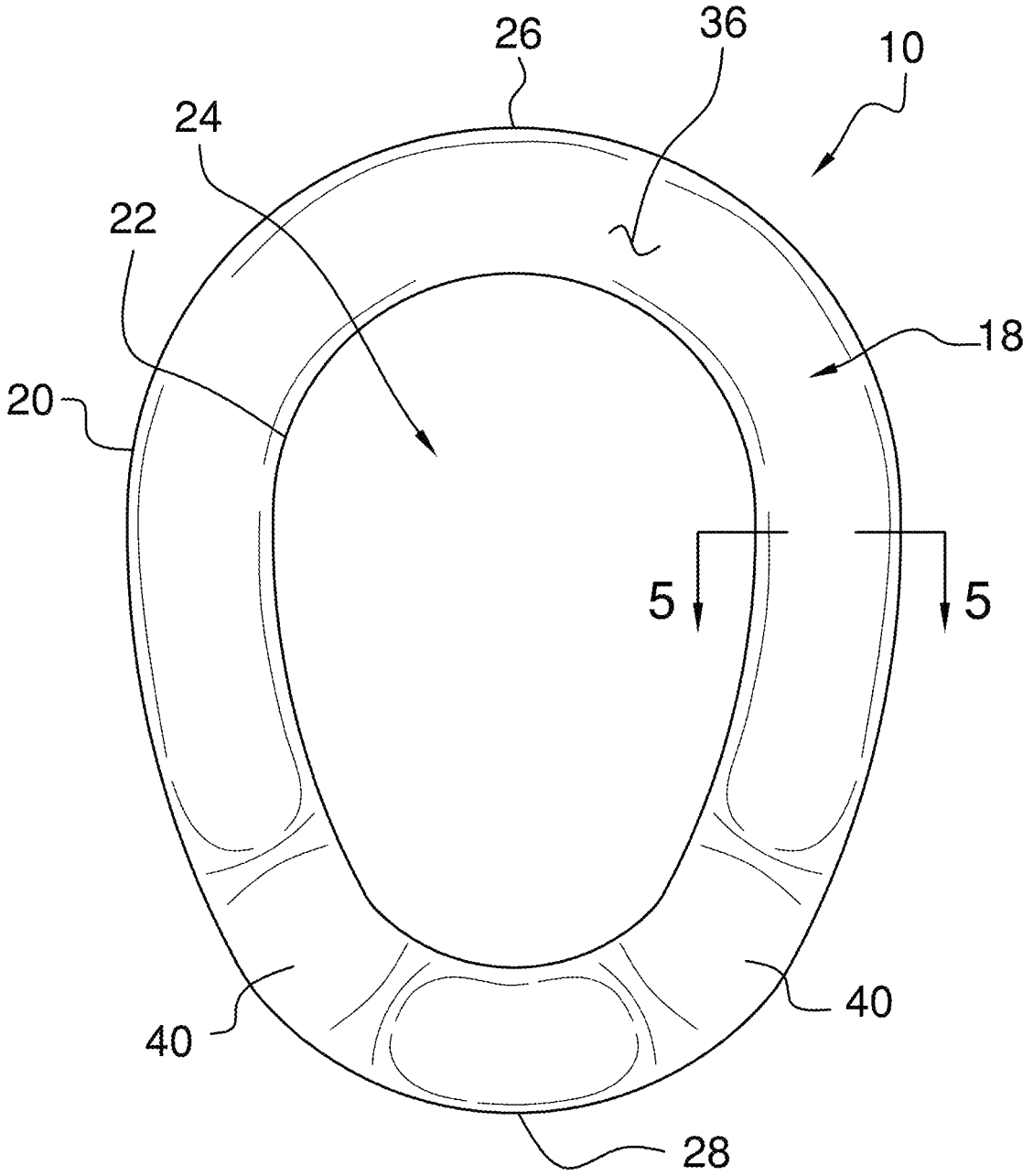
FIG. 1 is a top view of a cushion device according to an embodiment of the disclosure.
Figure 2:
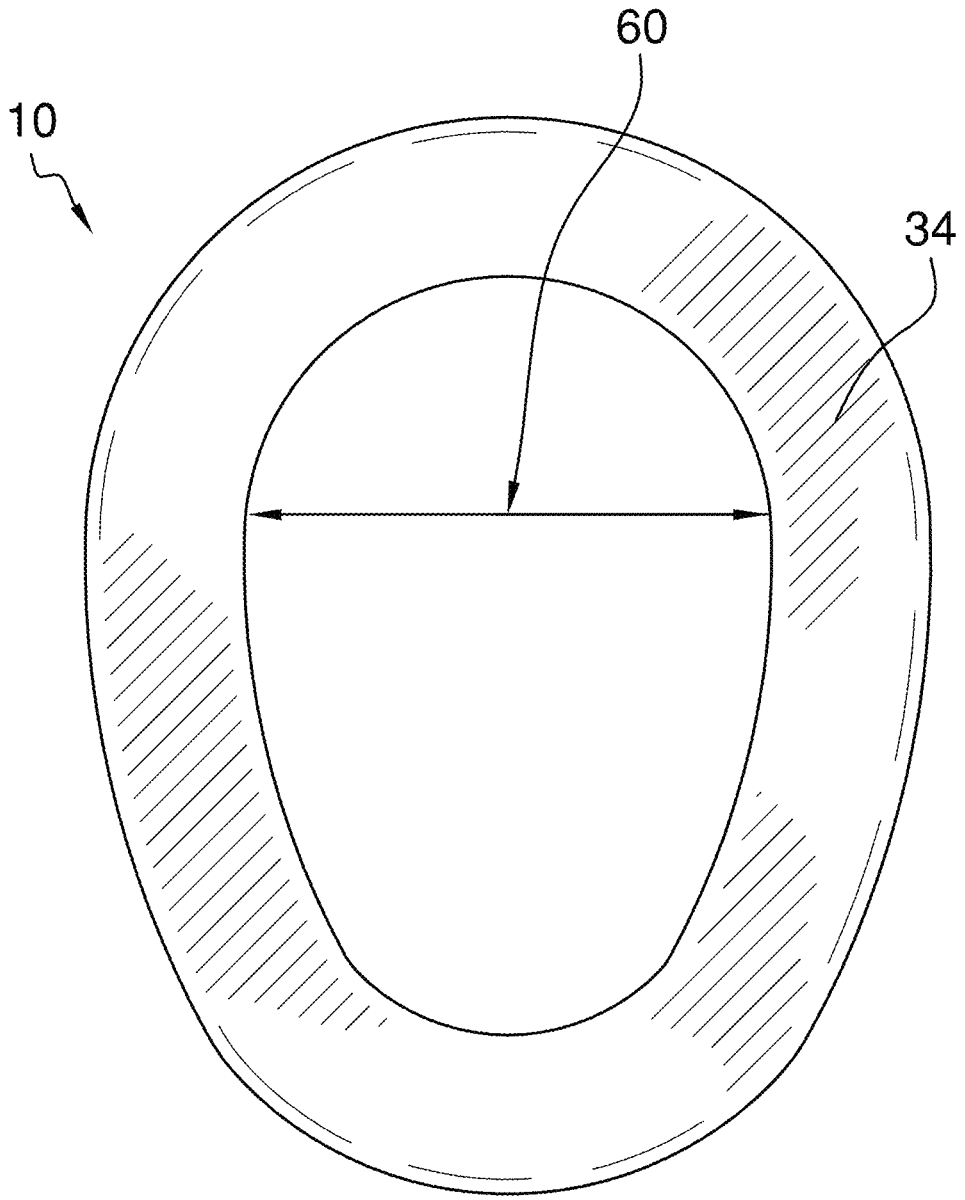
FIG. 2 is a bottom view of an embodiment of the disclosure.
Figure 3:
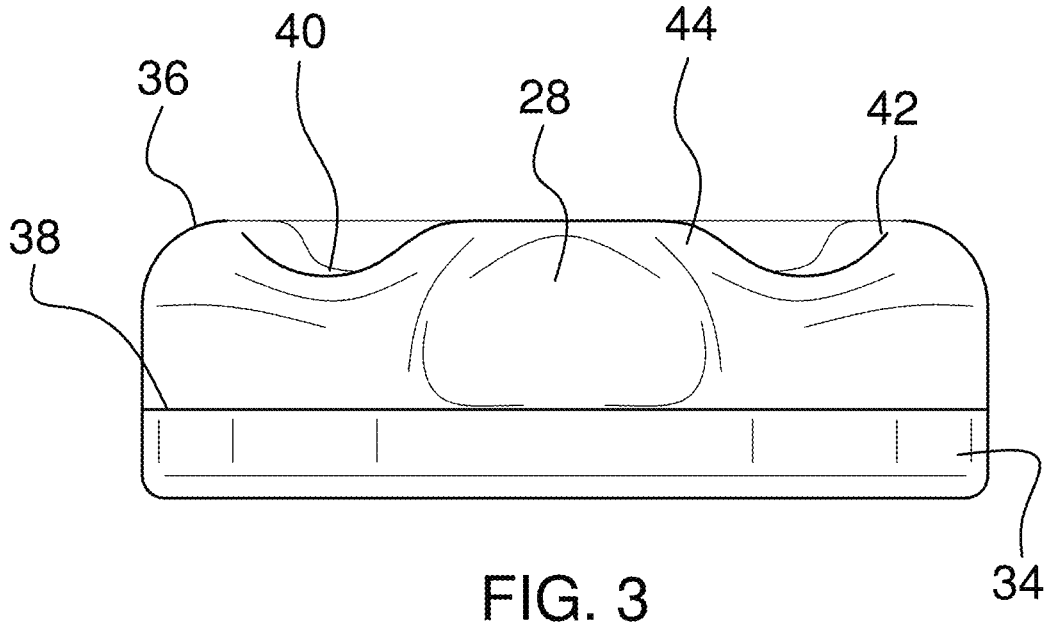
FIG. 3 is a front view of an embodiment of the disclosure.
Figure 4:
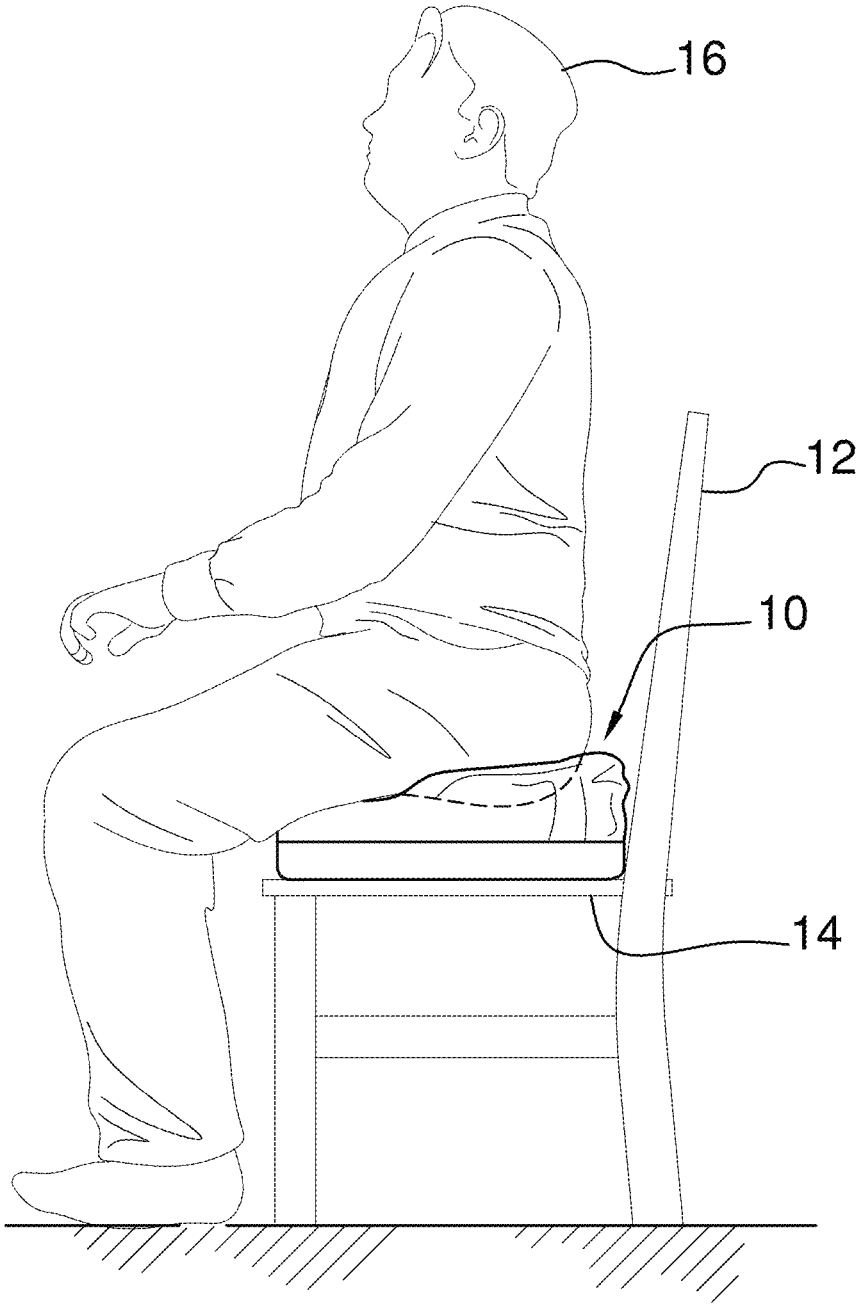
FIG. 4 is an in-use view of an embodiment of the disclosure.
Figure 5:
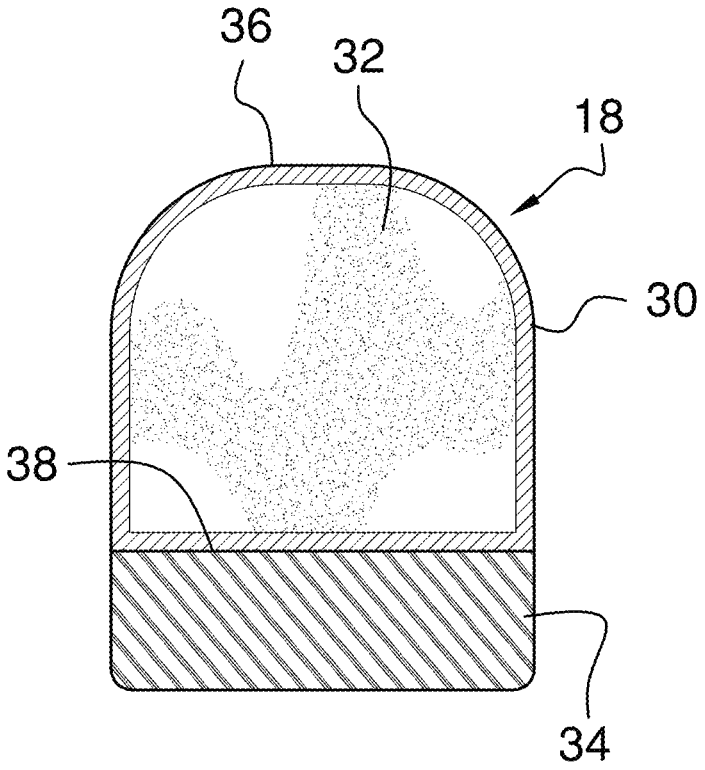
FIG. 5 is a cross-sectional view of an embodiment of the disclosure.
Figure 6:
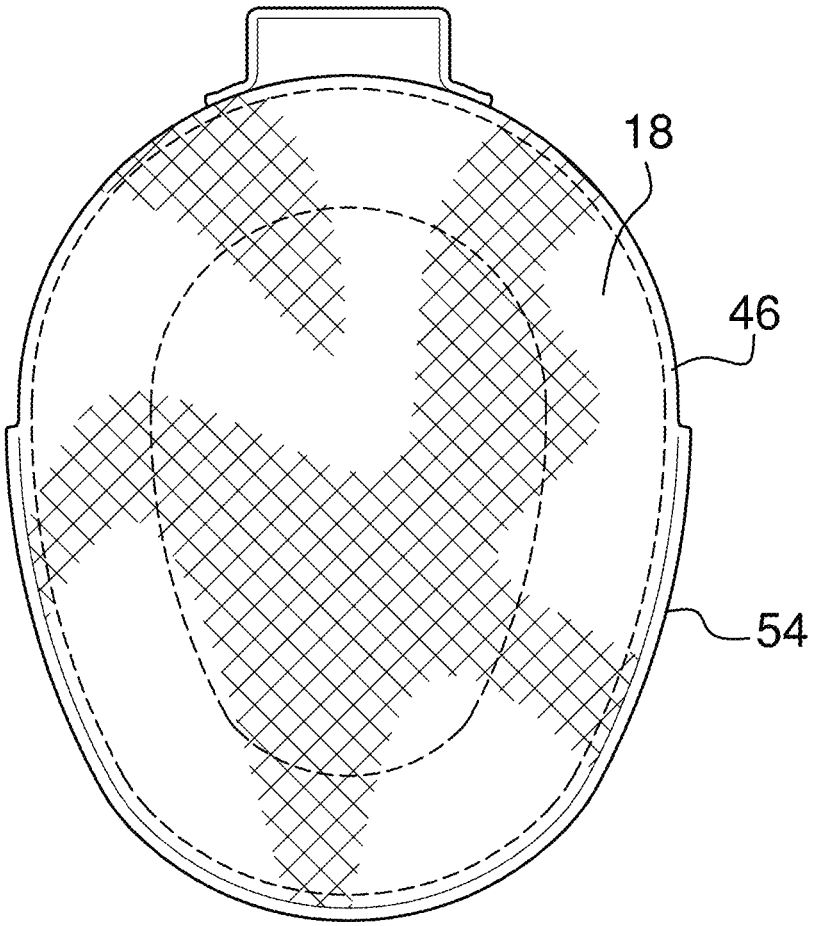
FIG. 6 is a top view of an embodiment of the disclosure.
Figure 7:
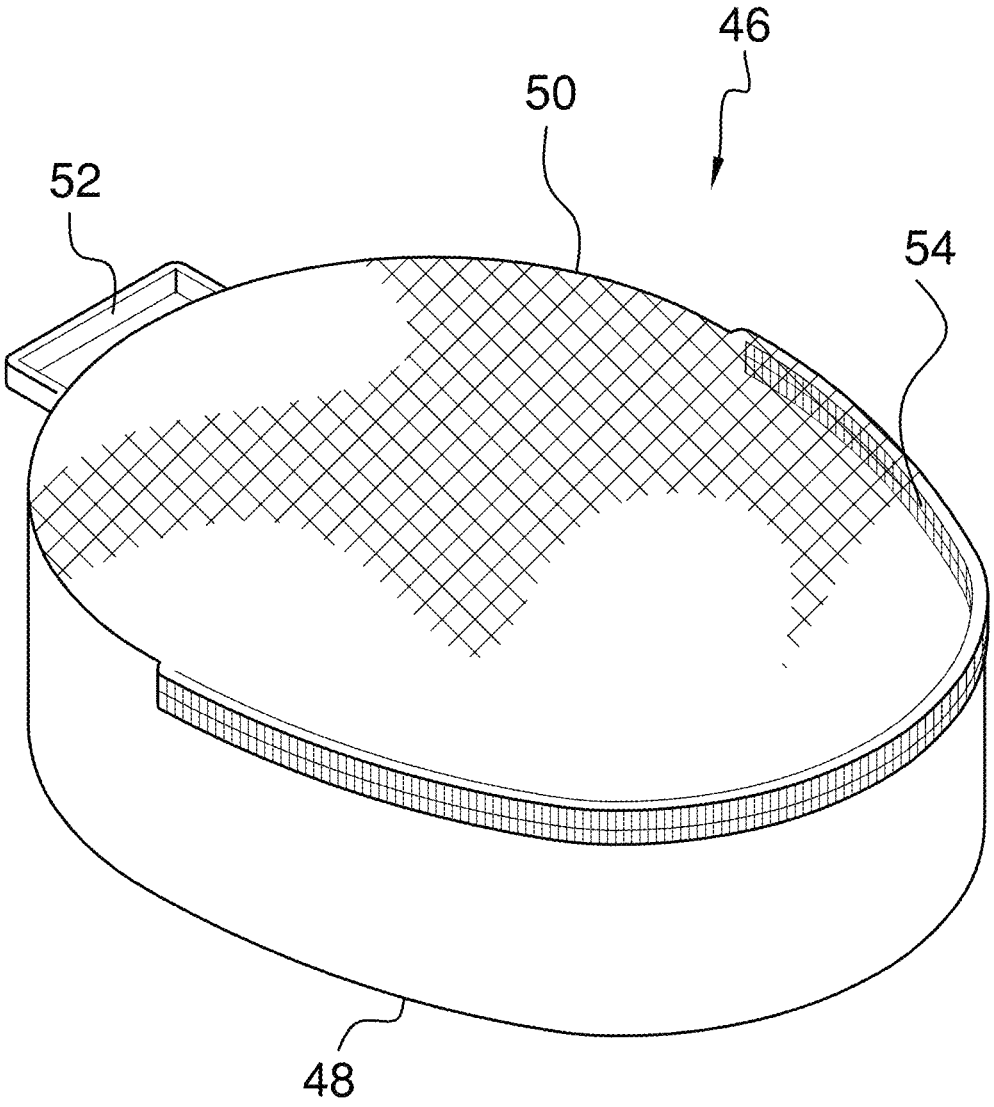
FIG. 7 is an isometric view of an embodiment of the disclosure.
Figure 8:
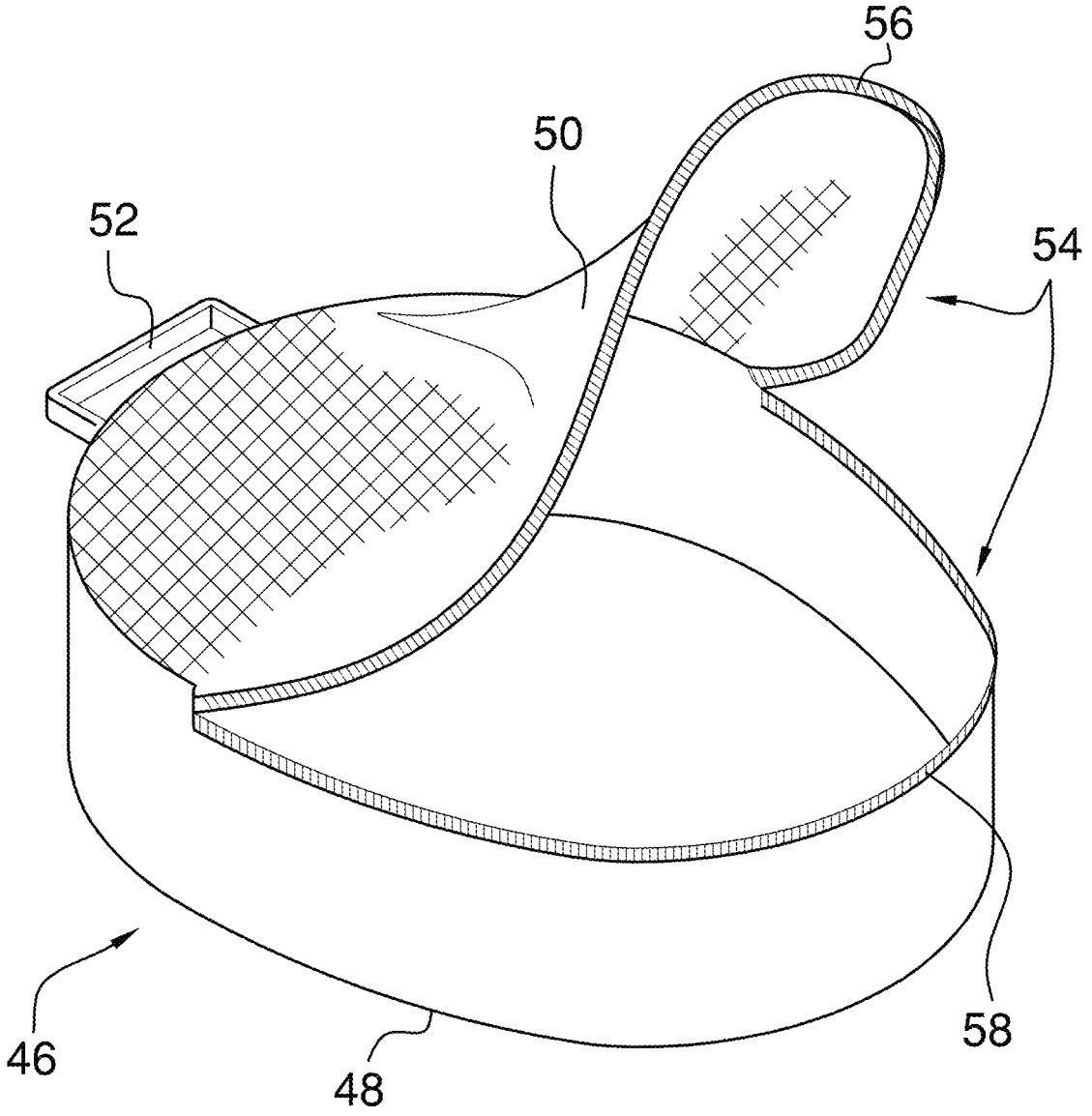
FIG. 8 is an isometric view of an embodiment of the disclosure.

With reference now to the drawings, and in particular to FIGS. 1 through 8 thereof, a new cushion embodying the principles and concepts of an embodiment of the disclosure and generally designated by the reference numeral 10 will be described.

As best illustrated in FIGS. 1 through 8, the cushion device 10 generally comprises a chair 12 that has a seat 14 wherein the chair 12 is configured to support a user 16. The chair 12 may be any kind of chair 12, including, but not limited to, a dining chair, a recliner, a lounge chair, a bench, a stadium seat, a bleacher, a folding chair, or any other device on which the user 16 may be seated. The seat 14 of the chair 12 may be rigid, although embodiments of the seat 14 that are cushioned are also contemplated.

A ring cushion 18 is removably positionable on the seat 14. More specifically, the ring cushion 18 is configured to be positionable between the seat 14 and the user 16. The ring cushion 18 has an outer edge 20 surrounding an inner edge 22. The inner edge 22 defines a cavity 24 that extends through the ring cushion 18. The cavity 24 has a diameter exceeding a distance that is measured between the outer edge 20 and the inner edge 22 wherein the cavity 24 is configured for being positioned around a tail bone of the user 16 while the user 16 is seated on the ring cushion 18. The inner edge 22 may be configured to surround a pair of gluteus medium muscles of the user 16.

The ring cushion 18 generally has a top side 36 and a bottom side 38. The ring cushion 18 also generally has a three-dimensional oval shape. The three-dimensional oval shape may be asymmetrical wherein the ring cushion 18 has a rounded end 26 and a tapered end 28. For example, a diameter of the ring cushion 18 may decrease moving away from the rounded end 26 and toward the tapered end 28.

The ring cushion 18 may include an outer casing 30 that is formed into the three-dimensional oval shape. A resiliently compressible material 32 may be enclosed within the outer casing 30 and define a filling that is configured to expand the outer casing 30 outwardly into the three-dimensional oval shape. The resiliently compressible material 32 is generally configured to facilitate comfort of the user 16 when the user 16 is seated on the ring cushion 18. For example, the resiliently compressible material 32 is generally selected from a group of materials consisting of cotton, linen, bamboo, hemp, polyester, rayon, viscoelastic gel, and thermoplastic elastomer gel.

A base 34 is fixedly attached to the ring cushion 18 wherein the base 34 is configured to support the ring cushion 18 over the seat 14. Accordingly, the base 34 is generally positioned on the bottom side 38 of the ring cushion 18. The base 34 and the ring cushion 18 are configured to suspend the tail bone and the pair of gluteus medium muscles of the user 16 above the seat 14. In other words, substantially all of a buttocks of the user 16 may be positioned within the cavity 24 and suspended over the seat 14, such that substantially all of the buttocks of the user 16 is spaced from the seat 14 to reduce pressure on the buttocks and facilitate comfort of the user 16. The tailbone of the user 16, in particular, may be suspended over the seat 14 to reduce compression of the tailbone and a spine of the user 16. Additionally, the pair of gluteus medium muscles may also be suspended over the seat 14 to further reduce downward pressure on, and compression of, the tailbone and the spine. The base 34 is generally rigid wherein the base 34 is configured to inhibit the resiliently compressible material 32 of the ring cushion 18 from being compressed into the seat 14 while the user 16 is seated on the ring cushion 18.

The base 34 may have a shape that is the same as a shape of the bottom side 38 of the ring cushion 18. In such embodiments, the base 34 fully covers the bottom side 38 of the ring cushion 18 and the bottom side 38 of the ring cushion 18 fully covers the base 34. The base 34 may have a height that is less than a height of the ring cushion 18. The height of the ring cushion 18 is generally measured between the top side 36 and the bottom side 38 of the ring cushion 18. In preferred embodiments, the height of the ring cushion 18 is generally measured at the rounded end 26.

The cushion device 10 may be particularly useful when the user 16 has an injury or other medical condition that makes sitting on rigid surfaces painful or uncomfortable. Accordingly, the base 34 and the ring cushion 18 may have a combined weight is under 5.0 pounds. The combined weight of the base 34 and the ring cushion 18 is generally configured to facilitate the user 16 in transporting the ring cushion 18 and the base 34. Such embodiments are preferred so that the user 16 can easily carry the base 34 and the ring cushion 18 with them, for example while travelling or when attending athletic events.

A pair of depressions 40 extend into the ring cushion 18. The pair of depressions 40 are spaced from each other wherein the pair of depressions 40 are configured to be positioned beneath a pair of legs of the user 16 when the user 16 is seated on the ring cushion 18. Accordingly, the pair of depressions 40 are generally positioned on the top side 36 of the ring cushion 18. The pair of depressions 40 are also generally positioned proximate to the tapered end 28.

Each depression of the pair of depressions 40 may include a first end 42 that extends between the outer edge 20 and the inner edge 22 of the ring cushion 18. A second end 44 may extend between the outer edge 20 and the inner edge 22 of the ring cushion 18. The top side 36 of the ring cushion 18 may be concavely arcuate between the first end 42 and the second end 44 of each depression of the pair of depressions 40. Thus, the pair of depressions 40 are configured to reduce the height of the ring cushion 18 while the user 16 is not seated on the ring cushion 18. In other words, the pair of depressions 40 extend downwardly into the top side 36 of the ring cushion 18 even when the user 16 is not sitting on the ring cushion 18.

A case 46 may be removably positionable to cover the ring cushion 18 and the base 34. The case 46 may including a mesh material that is configured to facilitate airflow to the ring cushion 18 and the base 34 when the ring cushion 18 and the base 34 are positioned within the case 46. In some embodiments, all or substantially all of the case 46 may be formed of the mesh material.

For example, the case 46 may include a lower covering 48 that is positionable beneath the base 34. An upper covering 50 may be pivotably coupled to the lower covering 48. More specifically, the upper covering 50 may be pivotable away from the lower covering 48 to position the ring cushion 18 and the base 34 within the case 46.

A handle 52 may be coupled to the upper covering 50 wherein the handle 52 is configured to facilitate the user 16 in carrying the case 46. Accordingly, the handle 52 may extend outwardly from the case 46. In some embodiments, the handle 52 may be positioned on the upper covering 50 of the case 46.

A fastener 54 may releasably secure the upper covering 50 of the case 46 against the lower covering 48 to inhibit the upper covering 50 from being pivoted away from the lower covering 48. For example, the fastener 54 may include a first mating member 56, which may be attached to an outer surface of the lower covering 48. A second mating member 58 is generally removably engageable with the first mating member 56. The second mating member 58 may be attached to an inner surface of the upper covering 50. Preferred embodiments of the fastener 54 include a zipper and a hook and loop material because they are lightweight and easy to open and close. However, other embodiments of the fastener, such as magnets and snaps, are also contemplated.

In use, the base 34 can be placed on top of the seat 14, which will position the ring cushion 18 over the seat 14. The pair of depressions 40 can be positioned near a forward edge of the seat 14 such that the pair of depressions 40 are configured for is positioned beneath the pair of legs of the user 16. The user 16 may sit on the ring cushion 18 with their tailbone and pair of gluteus medium muscles positioned within the cavity 24 such that the tailbone and the pair of gluteus medium muscles are suspended above the seat 14. Thus, the resiliently compressible material 32 of the ring cushion 18 can facilitate comfort of the portions of the buttocks of the user 16 which are positioned on the top side 36 of the ring cushion 18, while the cavity 24 allows the tailbone and the pair of gluteus medium muscles to be suspended over the seat 14 without being compressed onto the seat 14. The base 34 inhibits the ring cushion 18 from being compressed into the seat 14, ensuring that the tailbone and the pair of gluteus medium muscles of the user 16 remain suspended over the seat 14 rather than resting directly on any surface.

To transport the cushion device 10, the base 34 and the ring cushion 18 may be placed into the case 46. The fastener 54 may be engaged to secure the lower covering 48 and the upper covering 50 around the base 34 and the ring cushion 18. The combined weight of the base 34 and the ring cushion 18 is configured to facilitate transport, as explained above. Therefore, the materials from which the base 34 and the ring cushion 18 are made are preferably light weight to ensure that that the combined weight of the base 34 and the ring cushion 18 is 5.0 pounds or less. The handle 52 of the case 46 may also facilitate transport, making it easy for the user 16 to carry the case 46. The mesh material of the case 46 can protect the ring cushion 18 and the base 34 during transport while still allowing airflow to the ring cushion 18 and the base 34.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable cushion system comprising:

a chair having a seat wherein the chair is configured to support a user;

a ring cushion being removably positionable on the seat wherein the ring cushion is configured to be positionable between the seat and the user, the ring cushion having an outer edge surrounding an inner edge, the inner edge defining a cavity extending through the ring cushion, the cavity having a diameter exceeding a distance being measured between the outer edge and the inner edge wherein the cavity is configured for being positioned around a tailbone of the user while the user is seated on the ring cushion and wherein the inner edge is configured to surround a pair of gluteus medium muscles of the user;

a base being fixedly attached to the ring cushion wherein the base is configured to support the ring cushion on top of the seat of the chair whereby the base and the ring cushion are configured to suspend the tailbone and the pair of gluteus medium muscles of the user above the seat of the chair, the base being rigid wherein the base is configured to inhibit the ring cushion from being compressed into the seat while the user is seated on the ring cushion; and a pair of depressions extending into a top side of the ring cushion, the pair of depressions being spaced from each other wherein the pair of depressions are configured to be positionable beneath a pair of legs of the user when the user is seated on the ring cushion;

a case being removably positionable to cover the ring cushion and the base, the case further comprising a mesh material being configured to facilitate airflow to the ring cushion and the base when the ring cushion and the base are positioned within the case;

wherein the base and the ring cushion having a combined weight being under 5.0 pounds wherein the combined weight of the base and the ring cushion is configured to facilitate the user in transporting the ring cushion and the base; and each depression of the pair of depressions further comprising:

a first end extending between the outer edge and the inner edge of the ring cushion; and a second end extending between the outer edge and the inner edge of the ring cushion, the top side of the ring cushion being concavely arcuate between the first end and the second end of each depression of the pair of depressions.

2. The portable cushion system of claim 1, the case further comprising:

a lower covering being positionable beneath the base; and an upper covering being pivotably coupled to the lower covering wherein the upper covering is pivotable away from the lower covering to position the ring cushion and the base within the case.

3. The portable cushion system of claim 2, further comprising a handle being coupled to the case wherein the handle is configured to facilitate the user in carrying the case.

4. The portable cushion system of claim 2, the case further comprising a fastener releasably securing the upper covering against the lower covering to inhibit the upper covering from being pivoted away from the lower covering.

5. The portable cushion system of claim 1, wherein the base has a shape being the same as a shape of a bottom side of the ring cushion wherein the base fully covers the bottom side of the ring cushion and wherein the bottom side of the ring cushion fully covers the base.

6. The portable cushion system of claim 1, the ring cushion further comprising a three-dimensional oval shape.

7. The portable cushion system of claim 6, wherein the three-dimensional oval shape is asymmetrical and wherein the ring cushion has a rounded end and a tapered end.

8. The portable cushion system of claim 7, wherein the pair of depressions are positioned on the tapered end.

9. The portable cushion system of claim 6, the ring cushion further comprising:

an outer casing being formed into the three-dimensional oval shape; and a resiliently compressible material being enclosed within the outer casing and defining a filling being configured to expand the outer casing outwardly into the three-dimensional oval shape.

10. The portable cushion system of claim 9, the resiliently compressible material being selected from a group of materials consisting of cotton, linen, bamboo, hemp, polyester, rayon, viscoelastic gel, and thermoplastic elastomer gel.

11. A portable cushion system comprising:

a chair having a seat wherein the chair is configured to support a user;

a ring cushion being removably positionable on the seat wherein the ring cushion is configured to be positionable between the seat and the user, the ring cushion having an outer edge surrounding an inner edge, the inner edge defining a cavity extending through the ring cushion, the cavity having a diameter exceeding a distance being measured between the outer edge and the inner edge wherein the cavity is configured for being positioned around a tailbone of the user while the user is seated on the ring cushion and wherein the inner edge is configured to surround a pair of gluteus medium muscles of the user, the ring cushion having a top side and a bottom side, the ring cushion having a three-dimensional oval shape, the three-dimensional oval shape being asymmetrical wherein the ring cushion has a rounded end and a tapered end, the ring cushion including:

an outer casing being formed into the three-dimensional oval shape; and a resiliently compressible material being enclosed within the outer casing and defining a filling being configured to expand the outer casing outwardly into the three-dimensional oval shape, the resiliently compressible material being configured to facilitate comfort of the user when the user is seated on the ring cushion, the resiliently compressible material being selected from a group of materials consisting of cotton, linen, bamboo, hemp, polyester, rayon, viscoelastic gel, and thermoplastic elastomer gel;

a base being fixedly attached to the bottom side of the ring cushion wherein the base is configured to support the ring cushion over the seat whereby the base and the ring cushion are configured to suspend the tailbone and the pair of gluteus medium muscles of the user above the seat, the base being rigid wherein the base is configured to inhibit the resiliently compressible material of the ring cushion from being compressed into the seat while the user is seated on the ring cushion, the base having a shape being the same as a shape of the bottom side of the ring cushion wherein the base fully covers the bottom side of the ring cushion and wherein the bottom side of the ring cushion fully covers the base, the base having a height being less than a height of the ring cushion, the base and the ring cushion having a combined weight being under 5.0 pounds wherein the combined weight of the base and the ring cushion is configured to facilitate the user in transporting the ring cushion and the base;

a pair of depressions extending into the top side of the ring cushion, the pair of depressions being spaced from each other wherein the pair of depressions are configured to be positioned beneath a pair of legs of the user when the user is seated on the ring cushion, the pair of depressions being positioned proximate to the tapered end, each depression of the pair of depressions including:

a first end extending between the outer edge and the inner edge of the ring cushion; and a second end extending between the outer edge and the inner edge of the ring cushion;

the top side of the ring cushion being concavely arcuate between the first end and the second end of each depression of the pair of depressions;

a case being removably positionable to cover the ring cushion and the base, the case including a mesh material being configured to facilitate airflow to the ring cushion and the base when the ring cushion and the base are positioned within the case, the case including:

a lower covering being positionable beneath the base;

an upper covering being pivotably coupled to the lower covering wherein the upper covering is pivotable away from the lower covering to position the ring cushion and the base within the case;

a fastener releasably securing the upper covering against the lower covering to inhibit the upper covering from being pivoted away from the lower covering, the fastener including:

a first mating member being attached to an outer surface of the lower covering;

a second mating member being removably engageable with the first mating member, the second mating member being attached to an inner surface of the upper covering; and a handle being coupled to and extending from the case wherein the handle is configured to facilitate the user in carrying the case, the handle being positioned on the upper covering of the case.

* * * * *